US008061919B2

(12) United States Patent
Alarcon Grajeda

(10) Patent No.: US 8,061,919 B2
(45) Date of Patent: Nov. 22, 2011

(54) SPONGE CLEANING UTENSIL WITH INNER CORE FOR SOLID SOAP

(76) Inventor: Jesus Salvador Alarcon Grajeda, Eugene, OR (US)

( * ) Notice: Subject to any disclaimer, the term of this patent is extended or adjusted under 35 U.S.C. 154(b) by 949 days.

(21) Appl. No.: 11/649,473

(22) Filed: Jan. 4, 2007

(65) Prior Publication Data

US 2008/0166178 A1 Jul. 10, 2008

(51) Int. Cl.
*A47K 7/02* (2006.01)

(52) U.S. Cl. ..... 401/201; 15/244.4

(58) Field of Classification Search ..... 401/201, 401/196; 15/244.4

See application file for complete search history.

(56) References Cited

U.S. PATENT DOCUMENTS 1,748,406 A * 2/1930 Blair ..... 401/201
1,912,224 A * 5/1933 Schimel ..... 401/201
2,319,873 A * 5/1943 Linz ..... 15/244.4
2,829,392 A * 4/1958 Dupuy ..... 401/201
3,114,928 A 12/1963 Spiteri
3,428,405 A * 2/1969 Posner ..... 401/201
3,488,126 A * 1/1970 Avallone ..... 401/8
4,457,643 A 7/1984 Caniglia
6,318,922 B1 11/2001 Briggs
6,368,003 B1 4/2002 Sorrell
6,783,294 B2 8/2004 Duden et al.

* cited by examiner

*Primary Examiner* — David Walczak
(74) *Attorney, Agent, or Firm* — Morgan Law Offices, PLC

(57) ABSTRACT

A sponge cleaning utensil has an inner core for holding a cleaning agent and encouraging the cleaning agent to be continually in contact with water drawn into the inner core preferably via a plurality of conduits which are preferably molded into the sponge material. The inner core is fabricated so as to be substantially larger than the solid cleaning agent therein allowing the cleaning agent free movement within the core. This allows water to freely surround the cleaning agent creating rich lather production and the lather to be easily removed to the surface. The conduits preferably have openings at a plurality of positions on the sponge exterior surface so as to provide even moisture and lather to all portions of the sponge exterior including the edges.

18 Claims, 10 Drawing Sheets

SPONGE CLEANING UTENSIL WITH INNER CORE FOR SOLID SOAP

FIELD OF THE INVENTION

The present invention relates generally to cleaning utensils, and, more particularly, to a sponge cleaning utensil with an inner core for holding a cleaning agent and encouraging the cleaning agent to be continually in contact with water drawn into the inner core to produce rich lather.

BACKGROUND OF THE INVENTION

Various cleaning utensils for bathing have been developed for use in conjunction with bar soap or liquid personal washing cleansers. U.S. Pat. No. 3,114,928 to Spiteri and U.S. Pat. No. 4,457,643 to Caniglia, both entitled "Sponge for Containing Soap", describe sponge devices which use highly porous sponge material. However, this type of material does not have definite and consecutive open spaces leading to the center of the sponge so that water absorbed by the sponge is absorbed in layers tending to cause water to be trapped so that it cannot easily reach the soap. Another problem with devices such as these is the devices are constructed with the solid soap sandwiched between two flat sponges which tend to hold the soap too firmly in the center of the sponge. Thus, it is difficult for water to freely surround and mix with the soap to form lather, and also it is difficult for lather to be released. Although the prior art discloses employing cut or stamped holes, still the soap is not allowed to freely move about and be surrounded with water to encourage lather production, and the distribution of lather is limited. The holes are not well placed so that the edges of the sponge are not kept moistened, and the relatively large holes make water dissipate faster producing a poor concentration of lather. Another problem is that when the soap gets smaller it can become trapped in the inner edges of the device making the soap difficult to come into contact with water. Additionally, such devices tend to become weak from repeated use as the soap becomes smaller and the structure collapses. Other devices such as the one described in U.S. Pat. No. 6,738,294 to Duden et al., entitled "Solid Cleanser Holder," are constructed of materials that tend not to easily retain water and thus have poor lather production. When the cleaning agent gets smaller from repeated use the structure also becomes weak. Moreover, soap insertion is more difficult thereby demanding more effort by consumers.

There are also many well known cleaning utensils for other tasks such as dishwashing. These include various sponges and scrubber-sponge combinations. One problem associated with the conventional way of washing dishes using such devices is that the "set-up time" can be long. Consider what is required to simply wash a few dishes using a scrubber or sponge. First the utensil must be located, and then an appropriate container must be found and filled with water and then liquid dishwashing soap. Another problem associated with the regular way of washing dishes is that the cleaning utensil can contaminate the dishwashing water. Once the dishwashing water becomes dirty, it typically becomes "greasy" and loses its ability to effectively clean the remaining dishes. Assume that the dishwashing solution had an initial capacity to wash 30 plates. To accomplish this task of washing the 30 plates, the user would have to wash the cleaning utensil before sinking it into the dishwashing solution. However, in practice, this does not happen since it would require too much additional time to finish the job. Thus, the potential capacity is typically never realized. More liquid soap is used than is necessary thereby wasting resources. Yet another problem with the conventional way of washing dishes is that the user may forget that the dishwashing water from previous uses should be thrown out since it is contaminated. Or, the user may not be sure whether the dishwashing water is contaminated, so he or she may throw the dishwashing water away even though it could have been used to clean additional dishes safely.

Some cleaning utensils have hollow reservoirs for storing liquid soap. For example, some dishwashing utensils have a hollow handle for storing liquid dishwashing soap. The set-up is long and requires precision to pour the solid soap into the reservoir. Although these devices are convenient for washing plates and flatware, they are generally not suitable for reaching narrow areas such as those found in glassware. In general, they are difficult to manage. Because of their design, these utensils fail to afford the same flexibility of ordinary scrubbers and sponges.

Accordingly, it would be highly desirable for there to be a sponge cleaning utensil that overcomes the many deficiencies of the prior art and whose essential structure and principles of operation could be incorporated into a variety of different types of cleaning devices.

SUMMARY OF THE INVENTION

A sponge cleaning utensil has an inner core for holding a cleaning agent and encouraging the cleaning agent to be continually in contact with water drawn into the inner core preferably via a plurality of conduits which are preferably molded into the sponge material. The inner core is fabricated so as to be larger than the solid cleaning agent therein allowing the cleaning agent free movement within the inner core. This allows water to freely surround the cleaning agent creating rich lather production and the lather to be easily removed to the surface. The conduits preferably have openings at a plurality of positions on the sponge exterior surface so as to provide even moisture and lather to all portions of the sponge exterior including the edges. Each of the conduits forms a pathway from a starting point on the exterior surface to a terminal point at the inner core.

Experimentally, it was found that using a preferred embodiment of the sponge cleaning utensil described herein had numerous advantages over conventional washing techniques using liquid soap. A solid cleaning agent generally lasted much longer than liquid soap. In actual usage, a family of four members used an average of 38 fluid ounces of liquid soap on a monthly basis over three months when dishes were washed conventionally. However, when the sponge utensil was substituted over a similar period, this family used 60 percent less soap while cleaning the same number of dishes. Similar results are to be expected with regard to other washing applications and other embodiments of the present invention.

The sponge cleaning utensil can be made of various materials including synthetic urethane sponge, natural sponge, cellulose sponge, close cell foam, open cell foam, polyvinyl alcohol (PVA), in combination with fiber pads, cloth (natural or synthetic), mesh, and combinations thereof. In general, the sponge cleaning utensil can be made of any material or combination of materials now known or later developed suitable for water absorption and retention. The actual material(s) chosen to construct the sponge cleaning utensil described herein will generally depend on the particular cleaning task. The sponge cleaning utensil optionally includes a handle to help clean difficult-to-reach areas and make the user's work easier.

The cleaning agent is preferably a solid soap which is inserted into the sponge cleaning utensil. However, it is to be appreciated that the cleaning agent could be a liquid cleaning agent, a powder cleaning agent, a gel cleaning agent, or a semi-solid cleaning agent. The particular material used for the cleaning agent is a design choice for the skilled artisan of ordinary skill in the art, and will naturally depend on the tasks in which the invention will be used.

In various exemplary embodiments the sponge cleaning utensil has at least one entrance to allow insertion of solid soap, an inner core for holding the solid soap, and at least one conduit for water access. In these embodiments, the solid cleaning agent can be disposable (i.e., replaceable). In other exemplary embodiments, the solid soap is already included in the sponge cleaning utensil and the entrance is not present. In various exemplary embodiments, the body could be a unitary body or a body with multiple parts, sides, and edges. The body may be contour-shaped, double contour-shaped or instead have straight sides, curved sides, or a combination thereof.

In various exemplary embodiments of the present invention, the sponge cleaning utensil is secured near a work area using an optional clip hanger. The clip hanger is preferably constructed of plastic, rubber or some other flexible material, and preferably includes an oval-shaped body, a pin having a spherical head, and double-sided tape. The pin is connected to the body of the clip hanger and the sponge cleaning utensil attaches to the clip hanger by insertion of the pin into a hole in the sponge cleaning utensil. One side of the double-sided tape is preferably attached to the back of the body during the manufacturing process, making the clip hanger ready to use. The other side of the double-sided tape is preferably employed by the consumer to hold the clip hanger at a designated location, such as on a wall near the kitchen sink. Instead of using double-sided tape to secure the clip hanger, other fastening means, such as suction cups, may alternatively be employed.

In various exemplary embodiments, the essential structure and principles of operations can be incorporated into a variety of different types of cleaning utensils, such as, for example, devices used for cleaning dishes, detailing automobiles, bathing, and mopping.

These and other aspects, features and advantages of the present invention will become apparent from the following detailed description of preferred embodiments, which is to be read in connection with the accompanying drawings.

DESCRIPTION OF PREFERRED EMBODIMENTS

Figure 1:
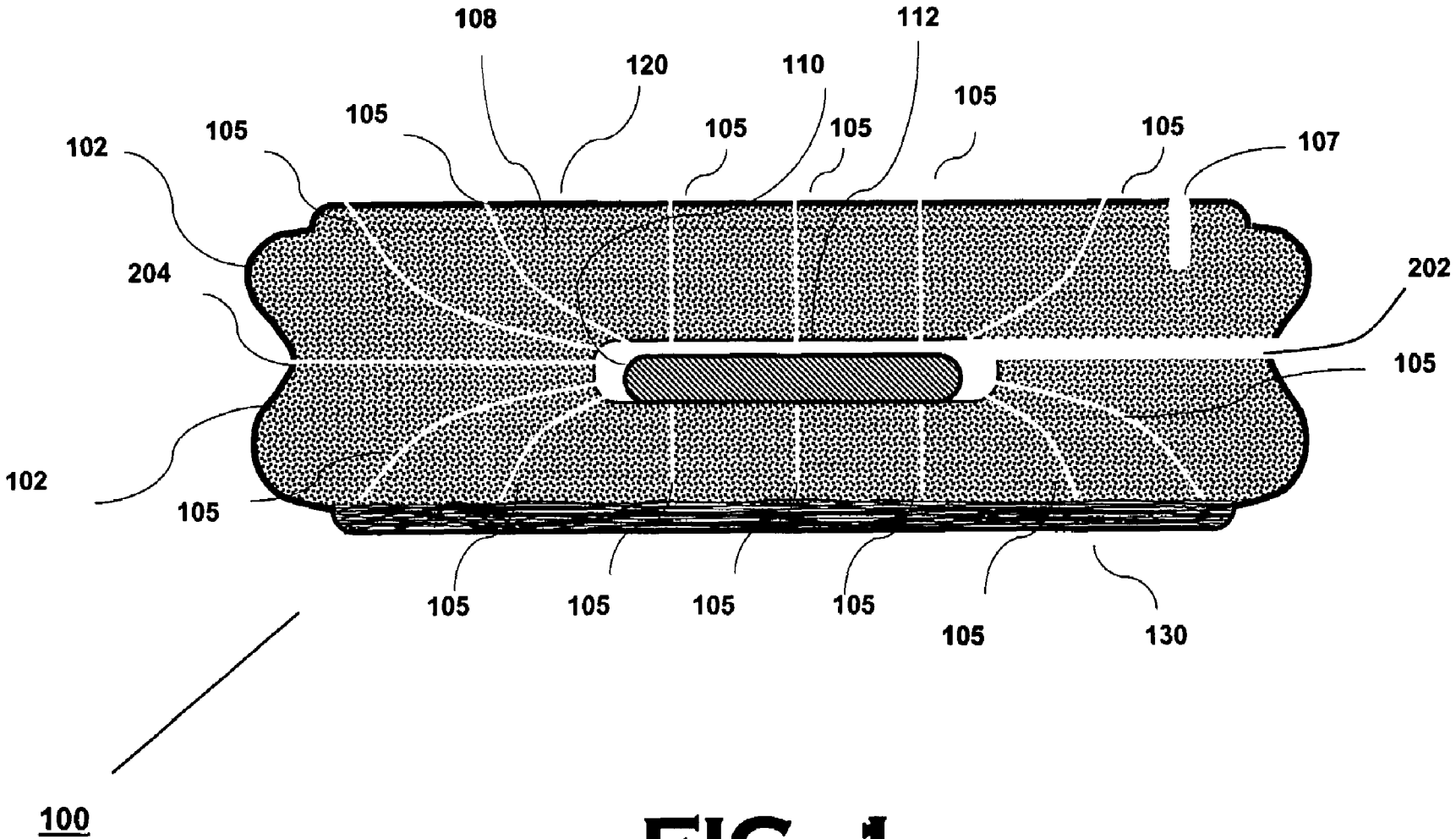
FIG. 1 is cross-sectional view of a sponge cleaning utensil with an inner core for holding a cleaning agent and various conduits which terminate at the inner core.

As depicted in FIG. 1, a sponge cleaning utensil 100 is constructed of a sponge-like material 108. The sponge-like material 108 can comprise various sponge materials including synthetic urethane sponge, natural sponge, cellulose sponge, open cell foam, close cell foam, or other absorptive materials such as, polyvinyl alcohol (PVA), fiber pads, cloth (natural or synthetic), mesh, and combinations thereof. In general, the sponge-like material 108 can be made of any material or combination of materials now known or later developed suitable for water absorption and retention. The shape of the sponge cleaning utensil 100 could be oval, square, triangular, spherical, or any other geometrical shape. The actual sponge-like material 108 chosen to construct the sponge cleaning utensil 100 described herein will generally depend on the particular cleaning tasks.

The sponge cleaning utensil 100 includes at least an inner core 112 that can hold a cleaning agent 110. The cleaning agent 110 is preferably a solid soap which is inserted into the inner core 112 of the sponge cleaning utensil 100 via an entrance. However, it is to be appreciated that the cleaning agent 110 could be a liquid cleaning agent, a powder cleaning agent, a gel cleaning agent, or a semi-solid cleaning agent, for example. The particular material used for the cleaning agent 110 is a design choice and will depend on the cleaning tasks in which the invention will be used. Further, the cleaning agent 110 could be placed into the inner core 112 of the sponge cleaning utensil 100 without use of the entrance 202 (in which case, the entrance 202 would be absent), such as by forming the sponge cleaning utensil 100 in portions and placing the solid cleaning agent 110 into the inner core 112 prior to final assembly.

The inner core 112 is preferably a mold of the cleaning agent 110 stored therein but substantially larger than the cleaning agent 110 allowing the cleaning agent 110 to freely move about within the inner core 112. The dimensions of the inner core 112 will vary according to the dimensions of the cleaning agent 110 in use and the tasks envisioned for the sponge cleaning utensil 100. In some cases the sponge cleaning utensil could have a substantially larger inner core 112 to hold the cleaning agent 110. Then when the solid cleaning agent 110 shrinks to a predetermined size and gets smaller, the user can introduce a new cleaning agent 110 refill into the inner core 112, In this case, the sponge cleaning utensil 100 would have the cleaning agent 110 refill into the inner core 112 and the original cleaning agent 110.

For example, the cleaning agent 110 for washing dishes might be oval-shaped and smaller than conventional bar soap. In this case the cleaning agent 110 might have a length of two inches, a width of one inch, and a thickness of a half inch. The inner core 112 might be approximately 10-20% larger in volume than the cleaning agent 110. The cleaning agent 110 for washing dishes preferably would be centered in the sponge cleaning utensil 100 located into the inner core 112 and allowing the sponge cleaning utensil 100 to easily bend for reaching narrow places (inside glassware, for example).

A plurality of conduits 105 is preferably utilized to allow liquid (e.g., dish, bath source water) to enter the inner core 112 from a variety of different places on the surface of the sponge cleaning utensil 100. The liquid is drawn into the inner core 112 and mixes with the cleaning agent 110 to form lather. In turn, the lather is removed (hand pumped) to the surface of the sponge cleaning utensil 100 via the conduits 105 and 204 (and the sponge-like material 102 itself). The conduits 105 and 204 could be configured in a circular, a triangular, a square, a rectangular, or any other geometric shape. Alternatively, or additionally, the conduits 105 and 204 could include a plurality of slits produced preferably by process molding, hot wire, die cutting, or any other suitable manufacture or process. The conduits 105 and 204 preferably have openings at a plurality of positions on the sponge exterior surface so as to provide even moisture and lather to all portions of the sponge exterior including the edges. Each of the conduits 105 and 204 form a pathway from a starting point on the exterior surface of the sponge cleaning utensil 100 to a terminal point at the inner core 112 for supplying water to the inner core 112. These starting points can be located at any arbitrary point on the exterior surface area.

One of ordinary skill in the art would appreciate that the sizes of the pores (cells) of the sponge material chosen are relevant in determining the number of conduits to form in the sponge material. There are various different types of synthetic and natural sponges that have relatively large pores that allow for fast and free access of water to the inner core 112. In some cases, inclusion of conduits will therefore not be necessary.

The inner core 112 also could be covered with a water-repellant material such as paint or any epoxy material. In this case, the sponge cleaning utensil 100 would have a "sealed inner core" 112, creating a pump. Liquid soap would be stored in the inner core 112 making the inner core 112 a liquid soap reservoir to supply liquid soap through the at least one conduit 105 or 204. In some applications, the inner core 112 forming this reservoir would be fashioned from a flexible rubber mold material or material similar to the inner core 112. Furthermore, the reservoir could be removable and have an entrance for the liquid soap. The entrance for the liquid soap could include an interlocking rib and groove closure (such as that found on ZIPLOC bags).

The conduits have a plurality of characteristics and functions:

(a) The conduits are all connected to the inner core 112. This includes the conduits 204 that originate from the edges and the conduits 105 that originate from the outer surfaces of both the soft and the rough sides. This arrangement allows speedy flow of water from the outer surfaces and edges to the inner core 112 and lather to be released from the inner core 112 to the outer surfaces and edges once it has been produced.

(b) When the sponge cleaning utensil 100 is hand-compressed by the consumer, air in the inner core 112 is easily released through the sponge material and the conduits 204 and 105 avoiding splashing or spreading the soap and water solution.

(c) The conduits 204 and 105 allow water to rapidly flow into the inner core 112 and mix with the solid cleaning agent 110 to produce rich lather. This provides the consumer with less waiting time for the production of lather to take place and faster time cleaning.

(d) The conduits 204, 105 help provide a lighter weight for the device which allow for superior manipulability and ease of use.

(e) The release of water solution is more precise and quickly distributed to the entirety of the surfaces of the sponge when the conduits 204, 105 are employed.

The inner core 112 is the engine of the sponge cleaning utensil 100 where the production of lather takes place. The inner core 112 has a plurality of characteristics and functions:

(a) The inner core 112 is the terminal point for the conduits 104, 105, supplying them constantly with water.

(b) Water accessed through the conduits 204, 105 allows the cleaning agent 110 to be freely surrounded by water within the inner core 112 so as to provide enhanced lather production as necessary, making the process continuous and synchronous with the user's needs.

(c) Lather created in the inner core 112 is pumped to the outer sponge surfaces and is precisely distributed to the entirety of the sponge cleaning utensil 100.

(d) The innercore 112 preferably being located in the approximate center of the devise allows the user to find the solid cleaning agent 110 easily by touch, and avoids the solid cleaning agent 110 being trapped or difficult to find. When the solid agent 110 becomes smaller, it will necessarily be confined to inner core 112 where it can be controlled and easily disintegrated.

(e) The structure of the inner core 112 helps produces a superior wash and faster and easy rinsing.

(f) The inner core 112 encapsulates the solid cleaning agent 110 keeping the solid cleaning agent 110 from being dislodged.

Figure 2A:
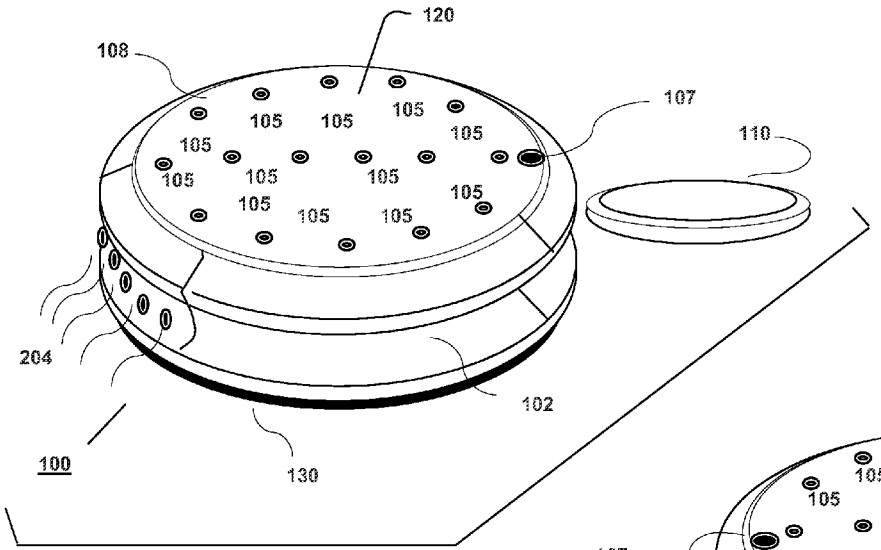
FIGS. 2(*a*) and 2(*b*) are top elevational views of the sponge cleaning utensil of FIG. 1.
Figure 2B:
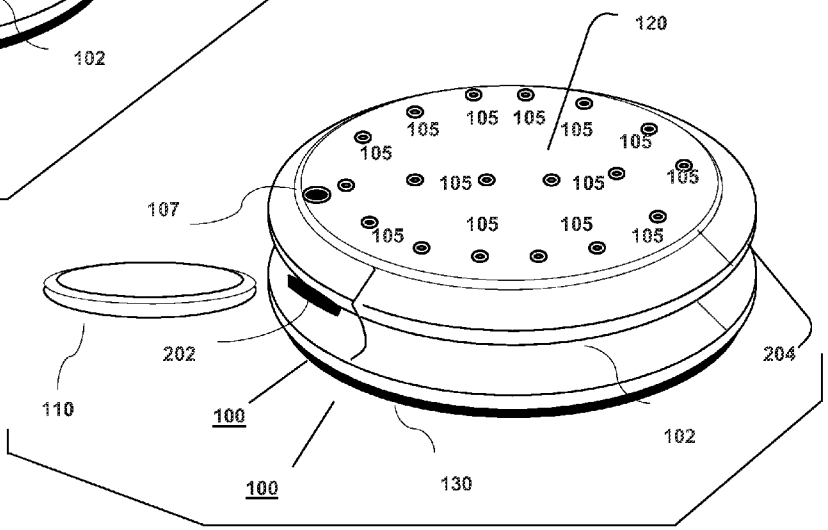

Referring to FIGS. 2(*a*) and 2(*b*), the sponge cleaning utensil 100 preferably includes at least one soft side 120 for not scratching or scraping on delicate surfaces and at least one hard side 130 for more tough cleaning tasks. The soft side 120 can be constructed of a scratch-resistant material to protect against scratching delicate surfaces using any process and materials that can produce or create a relatively soft surface. A perforation 107 could be either on the soft side 120 or the hard side 120 to be used to hang the sponge cleaning utensil 100 on an optional clip hanger device. The hard side 130 can be constructed using fibrous sheets or a scour pad glued in place using any suitable process for creating such a rough surface. Although the sponge cleaning utensil shown herein includes a soft side 120 and a hard side 130, it is to be appreciated that both sides of the sponge cleaning utensil 100 could be configured with only soft sides 120 or only with hard sides 130.

Both the soft side 120 and the hard side 130 preferably include respective openings for at least one or more conduits 105. Additional conduits such as the conduits 204 have important functions including:

(a) When the utensil is in a vertical position water cam be released directly to the object that is being washed, such as, for example a dish.

(b) Water can be drained from the sponge by gravity as it is hanged on a clip hanger device for a fast drying.

As illustrated in the drawings, the soft side 120 of the sponge cleaning utensil 100 includes a plurality of conduits 105 placed at various locations to allow for greater and more even water absorption and lather production. In addition, a plurality of conduits 204 is placed on a contour area 102. The solid cleaning agent 110 is shown prior to insertion into the entrance 202. Although FIGS. 2(*a*) and (*b*) illustrate the conduits 105 on the soft side 120, it is to be appreciated that there are also a plurality of such conduits 105 on the hard side 130 which are hidden from view.

Figure 3A:
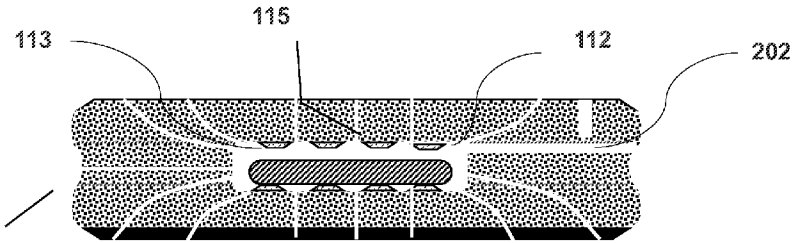
FIGS. 3(*a*) to 3(*c*) are cross-sectional views of other preferred embodiments of the present invention.
Figure 3B:
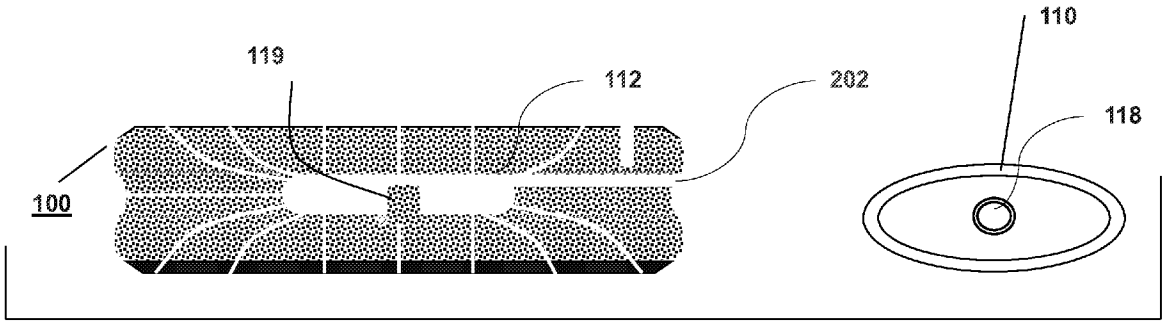
Figure 3C:
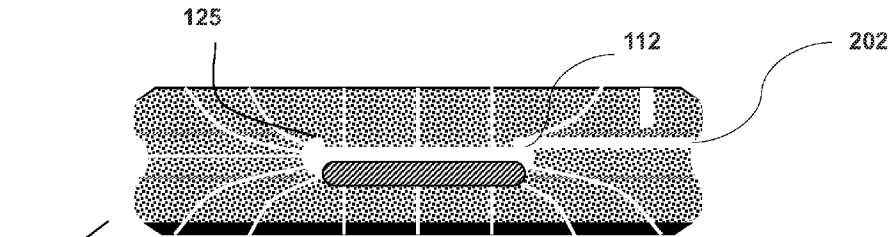
Figure 4:
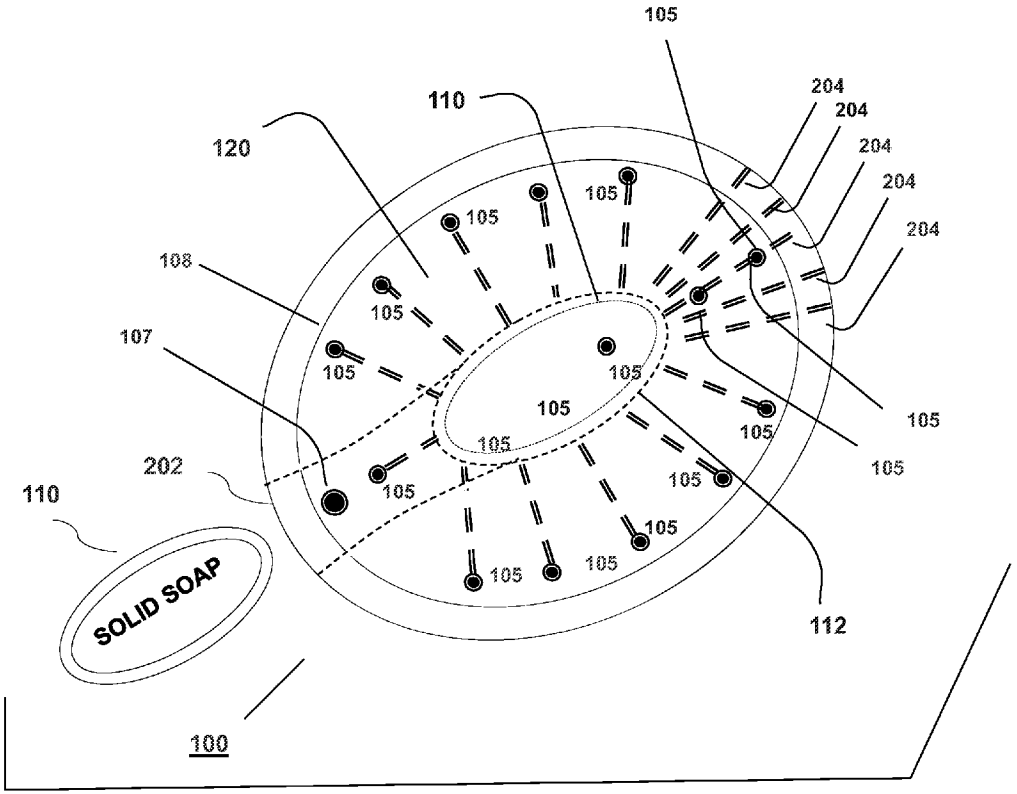
FIG. 4 is a top view of the sponge cleaning utensil of FIG. 1.

FIG. 3(*a*) is a representation of one embodiment of the present invention wherein the inner core 112 includes a plurality of tabs 113 used to securely hold the cleaning agent 110 in place within the inner core 112. The tabs 113 can be made of sponge, plastic or other water-resistant material, for example. FIG. 3(*b*) is a representation of another embodiment of the present invention wherein the inner core 112 includes a post 119 for holding the solid soap 110. In this case, the cleaning agent 110 includes a hole or ring 118 approximately the same diameter as the diameter of the post 119. When assembled, the cleaning agent 110 is placed into the inner core 112 with the post 119 snugly inserted into the hole or ring 118. FIG. 3(*c*) is a representation of another embodiment of the present invention wherein the inner core 112 includes at least one extension area 125. The at least one extension area 125 is cut out from the inner core 112 to extend the inner core 112. This arrangement enhances water flow, and may be suitable for some applications that require additional lather production. FIG. 4 is a top view of the sponge cleaning utensil 100. From this perspective, it is easy to see that the conduits 105 are placed so that water is drawn into the inner core 112 from different parts of the sponge cleaning utensil 100 and that lather is evenly delivered.

The sponge cleansing utensil 100 described herein preferably is fabricated by a process wherein individual items are produced by pouring foam chemicals into specially shaped molds and allowing the foam reaction to take place. Other ways to manufacture the sponge cleaning utensil 100 include forming the device using several sheets of sponge-like material. For instance, four sheets of sponge-like material could be utilized where the first sheet could be the top side followed by a second sheet glued to the first sheet which could be used to provide an entrance for the solid cleaning agent. A third sheet of sponge-like material could provide the assembly for the inner core to hold the solid cleaning agent. The fourth sheet could be glued to the third sheet and the second sheet, completing the body of the cleaning utensil. A fibrous sheet could also be glued to either side of the device creating a hard side for scrubbing purposes, with the other side used as a soft side. To make curved or contoured edges, an extruding device could be used or the edges could be cut using a cutting tool or formed using a hot wire tool. Conduits could be built by crossing the hot wire from the outer side and ending in the inner core of the device according with the position desired. Another way to create the sponge cleaning utensil 100 is by using two pieces of sponge material in which a side of each is cut according to the desired shape of the inner core. The two respective halves are then glued together with the cut-out sides facing each other to form the inner core and complete the device. Another way to manufacture the sponge cleaning utensil is by contour or pressure cutting (sometimes referred to as skiving), a high-speed process that converts soft foam materials into intricate cavities and contoured shapes. It is a rapid and efficient technique with low tooling costs. This can provide an economical alternative to conventional molding or thermoforming process. The manufacturing processes described herein are explained in relatively simple and straightforward manner, and it is to be appreciated that they are several of many possible processes which could be used to create the cleansing utensil described herein.

Figure 5:
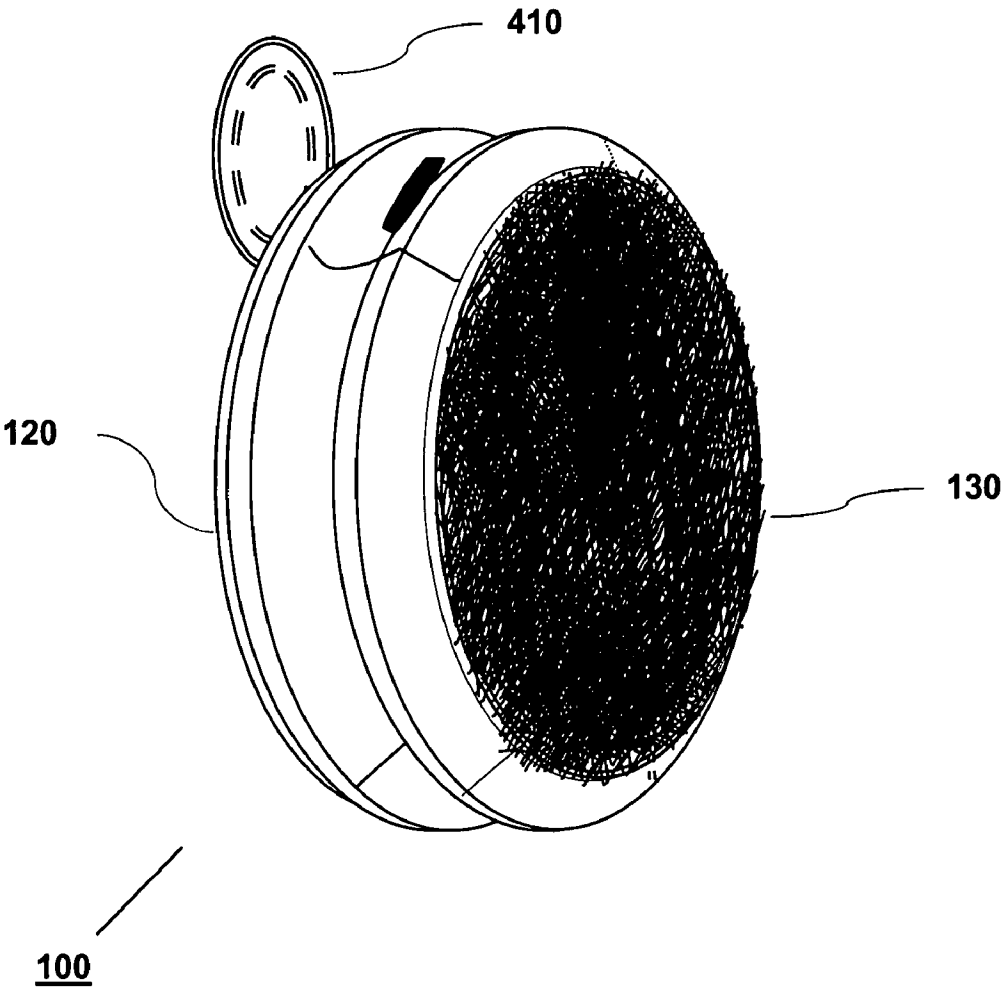
FIG. 5 illustrates a sponge cleaning utensil of the present invention employing a clip hanger.
Figures 6A, 6B, 6C, 6D:
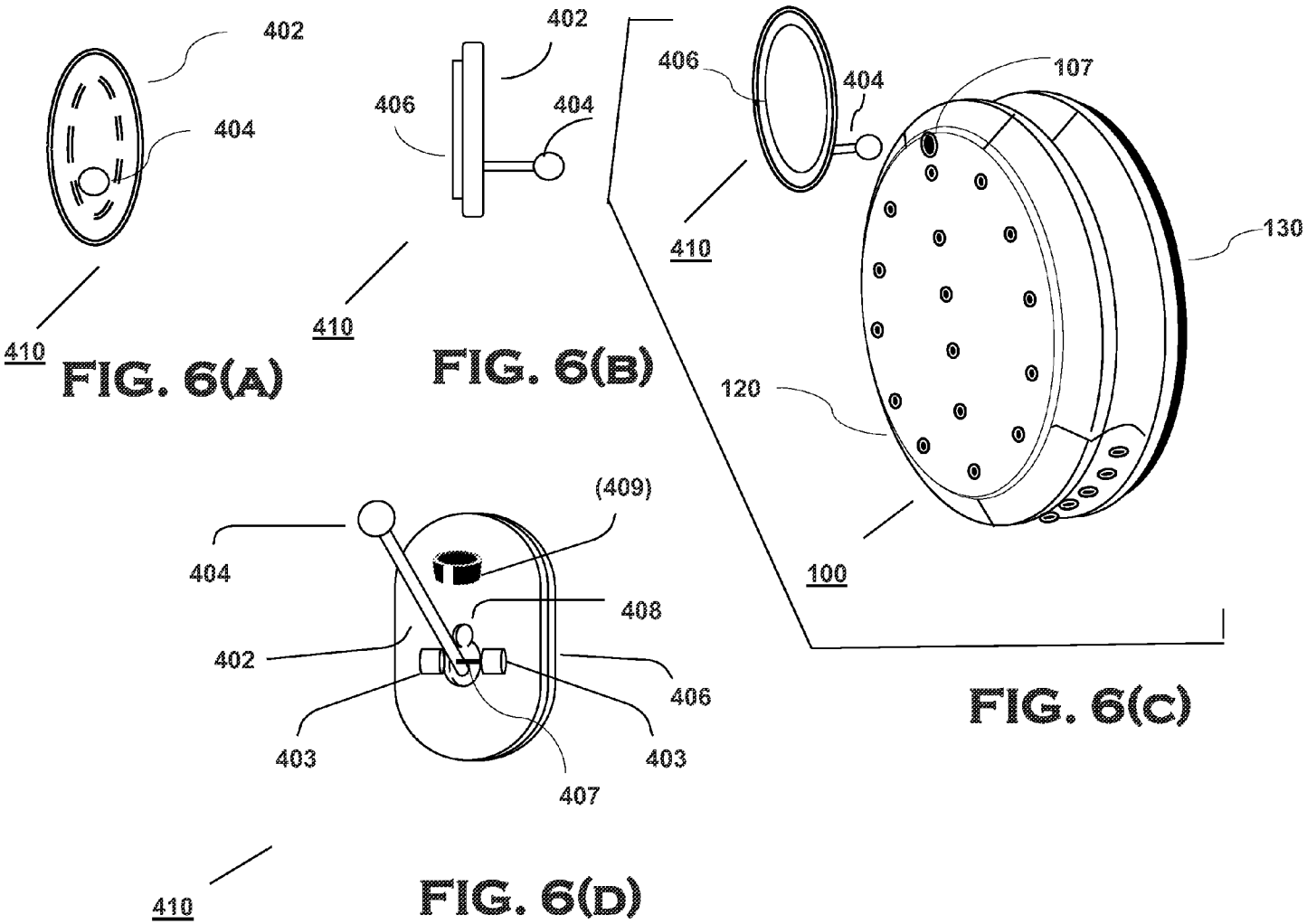
FIGS. 6(*a*) to 6(*d*) show various aspects and embodiments of the clip hanger.

FIG. 5 illustrates an embodiment of the present invention wherein the sponge cleaning utensil 100 is shown hanging on an optional clip hanger 410. FIGS. 6(*a*) to 6(*d*) show various aspects and inventive variations of the clip hanger 410. The clip hanger 410 is preferably constructed of plastic, rubber or some other flexible material and preferably includes an oval-shaped body 402, a pin 404 having a spherical head, and a double-sided tape 406. The pin 404 is connected to the body 402 of the clip hanger 410 and attaches to the sponge cleaning utensil 100 by insertion into a hole 107. One side of the double-sided tape 406 is preferably attached to the back of the body 402 during the manufacturing process, making the clip hanger 410 ready to use. The other side of the double-sided tape 406 is preferably employed by a consumer to hold the clip hanger 410 at a desired location, such as at a wall near a sink.

The clip hanger 410 has a plurality of characteristics and functions:

(a) The user will have the sponge cleaning utensil 100 available at any time that the user wants to use it and the clip hanger 410 provides a fast and easy way to reach for the device. Thus, the use of the clip hanger 410 will help the user achieve an organized and coordinated work cycle.

(b) The place where the clip hanger is secured will become the designated place where the sponge cleaning utensil 100 will be stored and located. Having a known and convenient place to hang the device will reduce the likelihood of misplacing the device.

(c) The clip hanger 410 provides for easy visual recognition of the device eliminating wasted time looking for the cleaning utensil.

(d) The shape and structure of the clip design does not occupy more than the necessary space for hanging the devise and leaves the cleaning utensil exposed allowing for fast drying.

(e) When the sponge cleaning utensil 100 hangs in the position where the water drips from the conduits, it may be drained into a sink or bathtub.

(f) In one embodiment, the pin 404 preferably includes a spherical head that allows the consumer easy assembly of the sponge onto the clip hanger by tact and not requiring sight. Also the spherical end has been designed for safety purposes where the customer cannot be accidentally injured.

In various embodiments of the present invention the clip hanger 410 could be secured to a wall or other surface by using one or more suction cups glued or otherwise attached to the back of the oval body 402. In these cases, the suction cups would be used instead of the double-sided tape 406.

Another clip hanger option is shown in FIG. 6(*d*). As depicted, the pin 404 is able to move in either a downward or an upward position. Rotation is accomplished by placing an axle 407 through the pin 404. The axle 407 is held firmly in place and not allowed to slip by securing blocks 403 on both ends of the axle 407. The blocks 403 are also attached to the oval body 402. When the pin 404 is the downward position (as shown) an oval perforation 408 works as a stopper allowing the pin 404 to be preferably positioned like a L (90 degree angle with respect to the oval body 402). In this position, the clip hanger 410 can be used to hang the sponge cleaning utensil 100. When the pin 404 is rotated in an upward position, it is in a position for non-use. In this position, the pin 404 can be held in place by a pin holder 409 that is preferably a circular structure as shown.

Figure 7A:
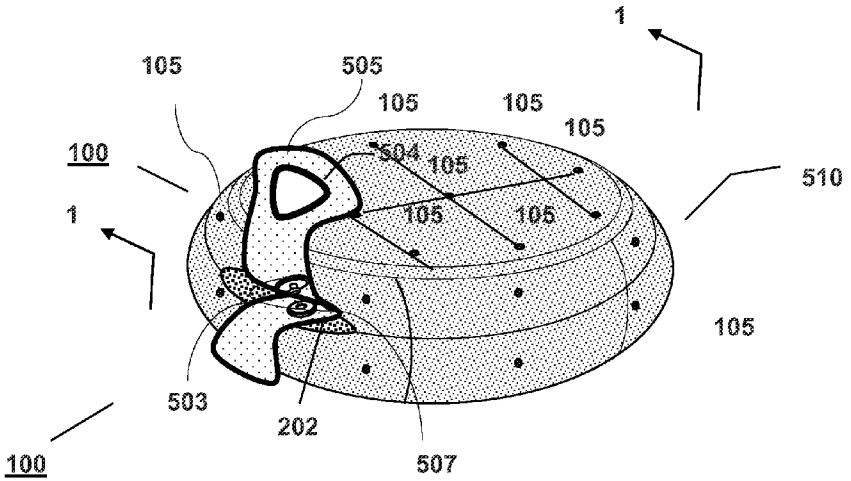
FIGS. 7(*a*) and 7(*b*) show an embodiment of the sponge cleaning utensil including a secondary chamber connected to an inner core to store a cleaning agent when it shrinks during use, the sponge cleaning utensil being held by an optional clip holder.
Figure 7B:
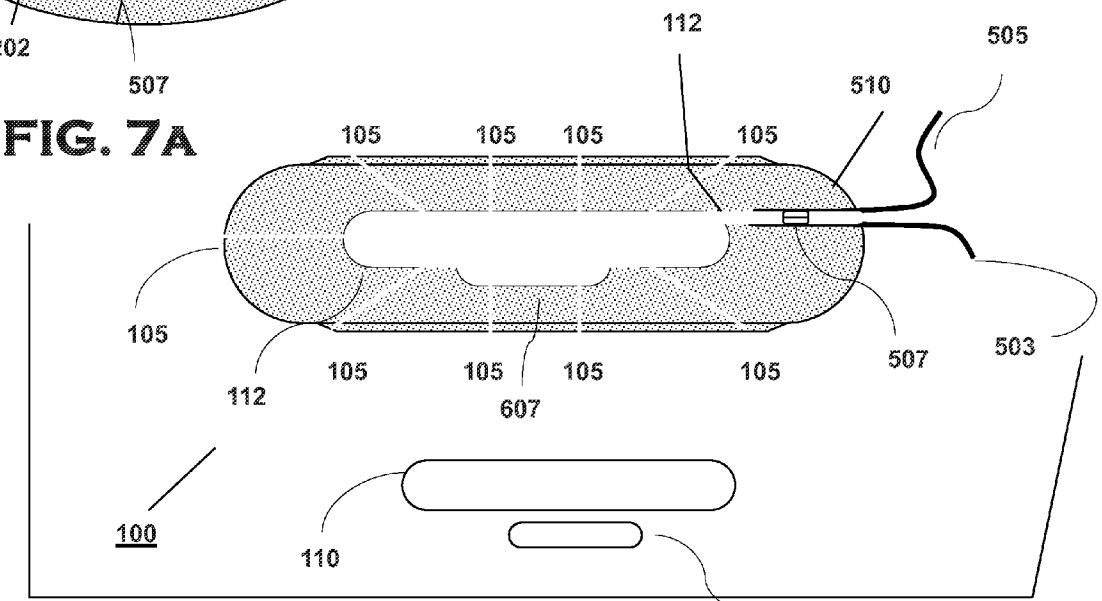

FIG. 7(*a*) shows an optional clip hanger 507 for holding the sponge cleaning utensil 100. At least one side of the sponge cleaning utensil 100 includes a rounded side 510, the rounded side 510 having the entrance 202 for inserting the cleaning agent 110 into the inner core 112 but also for securing the clip hanger 507. The clip hanger 507 preferably comprises an upper interlocking rigid part 505 and a lower interlocking rigid part 503 preferably made of plastic and capable of being connected together by pressure, such as by employing a snap button. Advantageously, the upper interlocking rigid part 505 and the lower interlocking rigid part 503 may also be disconnected to allow insertion of the cleaning agent 110 into the inner core through the entrance 202, e.g., to refill the device. The upper interlocking rigid part 505 is permanently attached to the roof of the entrance 202 and the lower interlocking rigid part 503 is permanently attached to the floor of the entrance 202. Preferably, one of the interlocking rigid parts is larger than the other. In the example shown and described herein, the upper interlocking rigid part 505 is larger than the lower interlocking rigid part 503 and preferably includes a triangular open space 504 to be used to hang the cleaning utensil sponge 100 on a hook.

FIG. 7(*b*) shows an embodiment of the sponge cleaning utensil 100 including a secondary chamber 607 connected to the inner core 112 to hold the cleaning agent 110 when it shrinks to a predetermined size. When the solid cleaning agent 110 gets smaller and is stored in the secondary chamber 607, the user can introduce a new cleaning agent 110 refill into the inner core 112. In this case, the sponge cleaning utensil 100 would have the cleaning agent 110 refill in the inner core 112 and the original cleaning agent 110 in the secondary chamber 607.

Figures 8A, 8B, 8C, 8D:
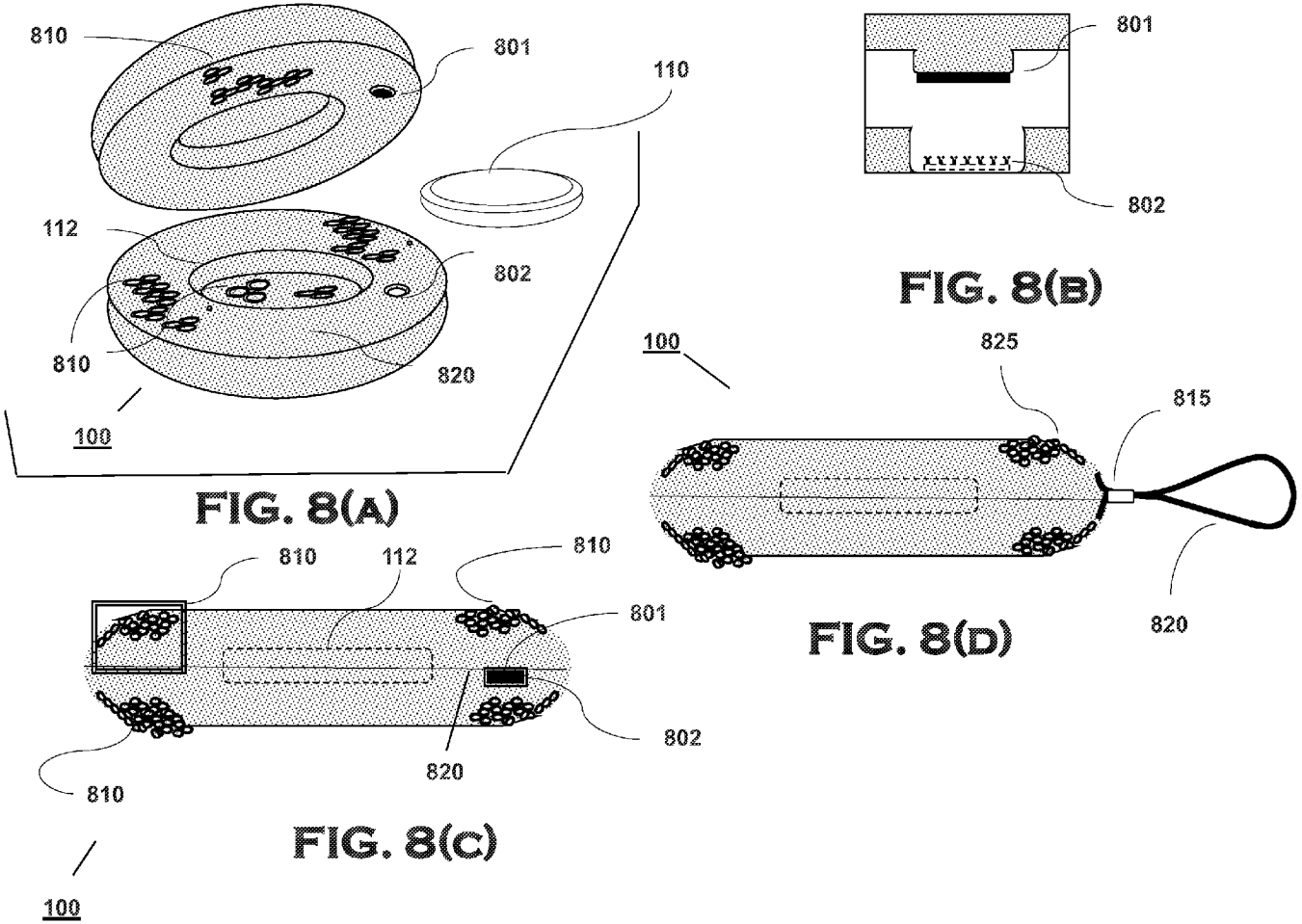
FIGS. 8(*a*) to 8(*d*) show various embodiments of the sponge cleaning utensil.

FIGS. 8(*a*) to 8(*d*) show various other embodiments of the sponge cleaning utensil.

FIG. 8(*a*) shows an embodiment of the sponge cleaning utensil 100 that includes two portions of sponge material. In this example, the inner core 112 is formed when both portions of the body are attached together. The "entrance" for the cleaning agent 110 would be free of glue, and strips of VELCRO 801, 802 could be used as an interlocking device in this area instead of glue. The cleaning agent 110 would be inserted into the inner core by pulling apart the strips of VELCRO 801, 802 creating an entrance to the inner core 112, then securing the strips of VELCRO 801, 802 to their original position once the cleaning agent 110 has been placed into the inner core 112. The inner core 112 encapsulates the cleaning agent 110 and keeps it inside of the inner core 112.

FIG. 8(*b*) shows a variation of this concept in which the interlocking device comprises a first portion of the sponge body having a protrusion with the strip of VELCRO 801 attached at the end thereto, and with the second portion of the body having a indentation about the same size and shape as the protrusion with the strip VELCRO 802 located at the bottom of the indentation. The first portion of the body and the second portion of the body can be attached or detached by hand compression. FIG. 8(*c*) illustrates that the VELCRO material is "hidden" from the user and cannot hurt the body of the user when the cleaning utensil is in use.

FIG. 8(*d*) shows an example of the sponge cleaning utensil 100 with an optional strap 820. The strap 820 preferably is made of a cloth string (or similar material) and includes a plastic stopper 815 with at least one perforation where the string is passed through. The stopper 815 helps keep the entrance of the sponge cleaning utensil 100 closed. The strap 820 can be used to hang the sponge cleaning utensil 100 on a hook when not in use. The strap 820 is also useful to hold the sponge cleaning utensil 110 on the operator's wrist to keep the sponge in control and to avoid dropping it.

In contrast to other illustrations, FIGS. 8(*a*) to 8(*d*) do not show the use of conduits to transfer liquid to the inner core. Sponges made of certain materials (such as sponges with relatively large pores) generally are able to absorb liquid easily and allow the liquid to quickly access the innermost portions of the sponge. Thus conduits are not always needed since liquid flow to the inner core would be sufficient without incorporating conduits into the design. Although FIGS. 8(*a*) to 8(*d*) show embodiments without conduits, it is to be appreciated that the features illustrated and discussed herein with reference to these figures could be incorporated into various embodiments of the invention that do include the use of conduits.

Figures 9A, 9B:
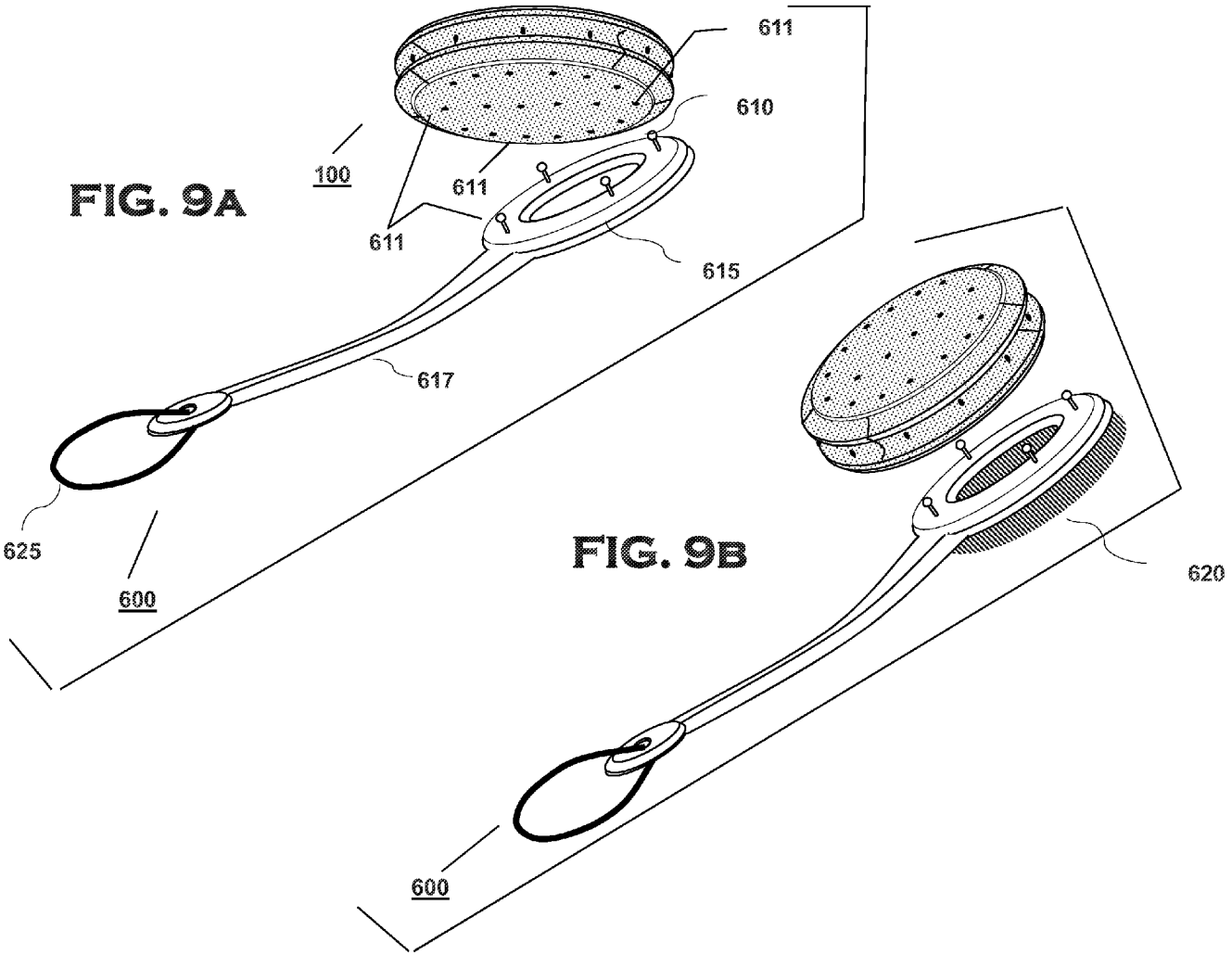
FIGS. 9 (*a*) and 9(*b*) show a cleaning utensil sponge holder and cleaning utensil holder with brush.

FIG. 9(*a*) shows a sponge cleaning utensil holder 600. The sponge cleaning utensil holder 600 includes an oval structure 615 with at least one pin 610, each of the at least one pin 610 having a spherical end for securing the sponge cleaning device 100 to the sponge cleaning utensil holder 600; a handle 617 for conveniently holding the sponge cleaning utensil holder 600 during cleaning; and a strap 625 for hanging the sponge cleaning utensil holder 600. The oval structure 615 is preferably about the same width as the sponge cleaning utensil 100. The sponge cleaning utensil 100 can be secured to the oval structure 615 by inserting each of the pins 610 into respective holes 611 in the oval structure 615. The holes 611 are fabricated such that their widths are the approximate size of the spherical ends of the pins 610 enabling a snug assembly. FIG. 9(*b*) shows another view of the sponge cleaning utensil holder 600.

Figure 10A:
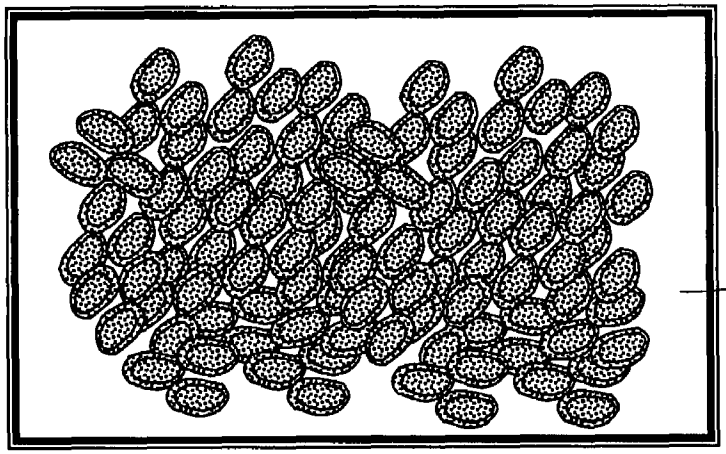
FIGS. 10(*a*) and 10(*b*) show close-up views of different types of sponge material.
Figure 10B:
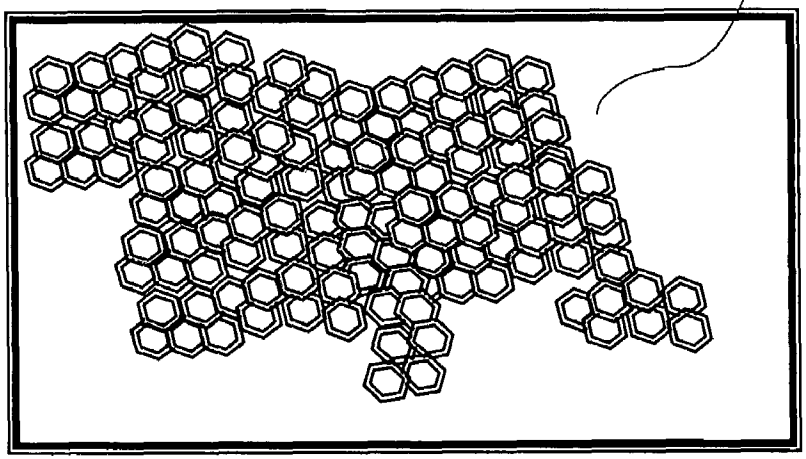

FIGS. 10(*a*) and 10(*b*) show close-up views of different types of sponges. The sponge materials 810, 811 have different size pores (cells) and the individual pores have different shapes. In general, the size of the pores will be an important factor in determining the number of conduits (if any) that are needed. Large pores allow for fast and free access of water to the inner core. In such cases, conduits may not even be necessary. Advantageously, newer manufacturing techniques using polyurethane sponges permit the size of the pores to be customized. This new technology can determinate and control the shape of the pores as well. Furthermore, material hardness and absorption properties can be customized. There are many different types of synthetic sponge material besides polyurethane that can also be customized for the cleaning task(s) envisioned.

Although illustrative embodiments of the present invention have been Described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A sponge cleaning utensil, comprising:

a body made of sponge material, the body having an inner core;

a solid soap stored in the inner core;

an entrance for the solid soap structured and arranged as a single opening in a side of the body; and a substantially horizontal pathway leading from the single entrance to the inner core, the inner core situated entirely inline and below the substantially horizontal pathway;

wherein the inner core retains its shape after insertion of the solid soap into the inner core such that after the insertion, a majority of an outer surface of said solid soap does not contact an inner surface of said inner core; and wherein the entrance maintains an open configuration when no outside force is applied thereto.

2. The sponge cleaning utensil of claim 1, wherein the solid soap is allowed free movement within the inner core to encourage water drawn into the inner core to mix with the solid soap to produce lather.

3. The sponge cleaning utensil of claim 1, further comprising at least one conduit, each of the at least one conduit forming a pathway from a starting point on an exterior surface area of the body to a terminal point at the inner core for supplying liquid to the inner core.

4. The sponge cleaning utensil of claim 3, wherein the starting point is any given point on the exterior surface area of the body.

5. The sponge cleaning utensil of claim 3, wherein the at least one conduit is formed by process molding.

6. The sponge cleaning utensil of claim 1, wherein the sponge material comprises one or more of synthetic urethane sponge, natural sponge, cellulose sponge, open cell foam, close cell foam, polyvinyl alcohol (PVA), fiber pads, cloth, and mesh.

7. The sponge cleaning device of claim 1, wherein the solid soap is a replaceable solid soap.

8. The sponge cleaning utensil of claim 1, wherein the inner core is coated with a water-repellant material.

9. The sponge cleaning utensil of claim 1, wherein the sponge cleaning utensil is fabricated such that the volume of the inner core is at least ten percent larger than the solid soap that is initially placed therein during a fabrication process.

10. The sponge cleaning utensil of claim 1, wherein the body includes one or more of a hard side and a soft side.

11. The sponge cleaning utensil of claim 1, further comprising a clip holder for holding the sponge cleaning utensil.

12. The sponge cleaning utensil of claim 1, further comprising a handle connected to the body.

13. The sponge cleaning utensil of claim 1, further comprising a secondary chamber connected to the inner core to hold the solid soap when it shrinks to a predetermined size.

14. The sponge cleaning utensil of claim 1, wherein the inner core is located at the approximate center of the body.

15. The sponge cleaning utensil of claim 1, wherein the inner core includes a plurality of tabs used to securely hold the solid soap in place within the inner core.

16. The sponge cleaning utensil of claim 1, wherein the inner core includes an extension area to extend the inner core to facilitate enhanced water flow.

17. The sponge cleaning utensil of claim 1, wherein the inner core includes a post to for inserting soap having a ring hole.

18. The sponge cleaning utensil of claim 1, further comprising:

a plurality of conduits, each of the conduits starting at any arbitrary point on an outer surface of the body and extending to the inner core.

* * * * *